US008164237B2

(12) United States Patent
Wen

(10) Patent No.: US 8,164,237 B2
(45) Date of Patent: Apr. 24, 2012

(54) LED LAMP WITH FLOW GUIDE FUNCTION

(75) Inventor: Fong-Yuan Wen, Taoyuan (TW)

(73) Assignee: Gem-Sun Technologies Co., Ltd., Taoyuan County (TW)

( * ) Notice: Subject to any disclaimer, the term of this patent is extended or adjusted under 35 U.S.C. 154(b) by 85 days.

(21) Appl. No.: 12/846,736

(22) Filed: Jul. 29, 2010

(65) Prior Publication Data

US 2012/0025687 A1 Feb. 2, 2012

(51) Int. Cl.
*F21V 29/02* (2006.01)
*H01J 61/52* (2006.01)

(52) U.S. Cl. ..... 313/46; 362/294; 362/373; 362/800

(58) Field of Classification Search ..... 313/45, 313/46; 362/294, 373, 800
See application file for complete search history.

(56) References Cited

U.S. PATENT DOCUMENTS 7,355,856 B2 * 4/2008 Petroski ..... 361/710
7,701,055 B2 * 4/2010 Wu et al. ..... 257/712
7,824,075 B2 * 11/2010 Maxik ..... 362/294
7,874,699 B2 * 1/2011 Liang ..... 362/249.02
8,066,414 B2 * 11/2011 Pabst et al. ..... 362/373
2005/0111234 A1 * 5/2005 Martin et al. ..... 362/555
2007/0253202 A1 * 11/2007 Wu et al. ..... 362/294
2008/0121900 A1 * 5/2008 Wu et al. ..... 257/88
2008/0253125 A1 * 10/2008 Kang et al. ..... 362/294
2009/0237932 A1 * 9/2009 Lee ..... 362/249.02
2009/0296387 A1 * 12/2009 Reisenauer et al. ..... 362/235
2010/0165632 A1 * 7/2010 Liang ..... 362/294
2011/0032708 A1 * 2/2011 Johnston et al. ..... 362/294
2011/0110095 A1 * 5/2011 Li et al. ..... 362/294

* cited by examiner

*Primary Examiner* — Peter Macchiarolo
(74) *Attorney, Agent, or Firm* — Chun-Ming Shih; HDLS IPR Services

(57) ABSTRACT

An LED lamp with a flow guide structure guides external air to dissipate heat from the LED lamp includes a lamp base, a heat dissipating body, a heat dissipating plate and an LED module installed in the lamp base, and heat dissipating holes formed on the lamp base. The heat dissipating body includes heat dissipating fins, and a heat dissipating passage defined between any two fins and disposed corresponding to the heat dissipating hole. The LED module is in a thermal contact with the heat dissipating plate. The heat dissipating plate is attached onto the heat dissipating fins and includes openings. A flow guide plate is formed at a lateral edge of each opening and extended from the heat dissipating plate for guiding external air into the heat dissipating passage and out from the heat dissipating hole to expedite a natural convection in the lamp and prevent a thermal aggregation.

10 Claims, 4 Drawing Sheets

LED LAMP WITH FLOW GUIDE FUNCTION

FIELD OF THE INVENTION

The present invention generally relates to a light emitting diode (LED) lamp, in particular to an LED lamp with a heat dissipating structure.

BACKGROUND OF THE INVENTION

In recent years, the light emitting diode (LED) technology blooms and becomes well developed, and LED features a low power consumption, a long lifespan, a small volume and a quick response, and thus LED lamps have gradually replaced traditional halogen bulbs and become a mainstream market.

In general, the higher power of the LED results in more waste heat produced. However, a high temperature has significant adverse effects on the life and light emitting performance of the LED, and thus the LED lamp with a higher power generally comes with a heat dissipating structure for dissipating heat of high temperature. The heat dissipating structure of a conventional LED lamp usually disperses waste heat from the LED lamp to the outside by convection, wherein a heat dissipating body is attached onto a backlight surface of the LED, and the heat dissipating body is comprised of a plurality of heat dissipating fins, such that the heat dissipating fins with a large heat dissipating area can be used for expediting the dissipation of waste heat produced while the LEDs are emitting light.

In the foregoing structure, although the heat dissipating area of the heat dissipating body can expedite the removal of the waste heat produced by the LEDs, yet the air flow speed of a natural convection is relatively slow, so that the heat dissipation process may still cause a heat aggregation easily, and the overall temperature of the LED lamp is relatively high, and thus affecting the using life and the light emitting efficiency of the LEDs.

In view of the foregoing shortcomings, the inventor of the present invention based on years of experience in the related industry to conduct extensive researches and experiments, and finally provided a feasible design to overcome the shortcomings of the prior art effectively.

SUMMARY OF THE INVENTION

Therefore, it is a primary objective of the present invention to provide an LED lamp with a flow guide function to expedite a natural convection of airflow in the LED lamp to prevent a heat aggregation.

To achieve the aforementioned objective, the present invention provides an LED lamp with a flow guide function for guiding external air to dissipate heat from the LED lamp, wherein the LED lamp comprises a lamp base, a heat dissipating body, a heat dissipating plate and an LED module, and the lamp base includes a containing space, and a plurality of heat dissipating holes formed on the lamp base, a heat dissipating body installed in the containing space, and the heat dissipating body includes a plurality of heat dissipating fins, and a heat dissipating passage defined between any two fins, and disposed corresponding to the heat dissipating holes, and the heat dissipating plate is attached onto the heat dissipating body, and the heat dissipating plate includes a plurality of openings formed around the heat dissipating plate, and a flow guide plate formed at a lateral edge of each opening and extended from the heat dissipating plate, and the flow guide plate guides external air into the heat dissipating passage and out from the heat dissipating hole, and the LED module includes a printed circuit board in a thermal contact with the heat dissipating plate and a plurality of LEDs electrically coupled to the printed circuit board.

Another objective of the present invention is to provide an LED lamp with a flow guide function for reducing the overall temperature of the LED lamp quickly, and preventing a high temperature from affecting the using life and light emitting efficiency of the LED lamp.

Compared with the prior art, the LED lamp of the present invention comprises a plurality of openings formed around the heat dissipating plate, a flow guide plate formed at a lateral edge of each opening and extended from the heat dissipating plate for guiding external air along the flow guide plate into the heat dissipating passage. When air flows through the openings, the air is passed through the openings with a smaller area, so that the airflow speed is increased to expedite a natural convection, and the heat of the heat dissipating body can be carried away quickly to lower the overall temperature of the LED lamp and prevent a thermal aggregation, so as to maintain the using life and the light emitting efficiency of the LED lamp and improve the practicability of the present invention.

DESCRIPTION OF THE PREFERRED EMBODIMENTS

The technical characteristics and contents of the present invention will become apparent with the following detailed description accompanied with related drawings, but the drawings are provided for reference and illustration of the invention only, but not intended for limiting the scope of the invention.

Figure 1:
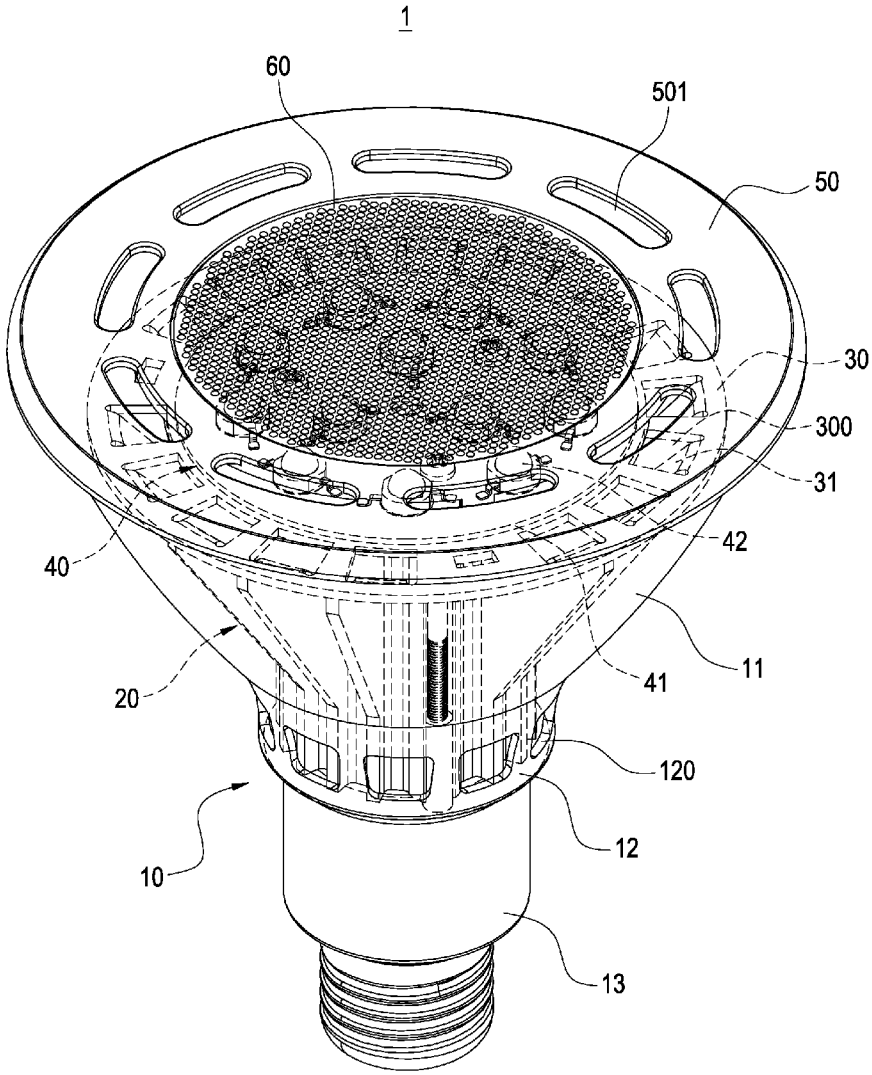
FIG. 1 is a perspective view of an LED lamp with a flow guide function in accordance with present invention.
Figure 2:
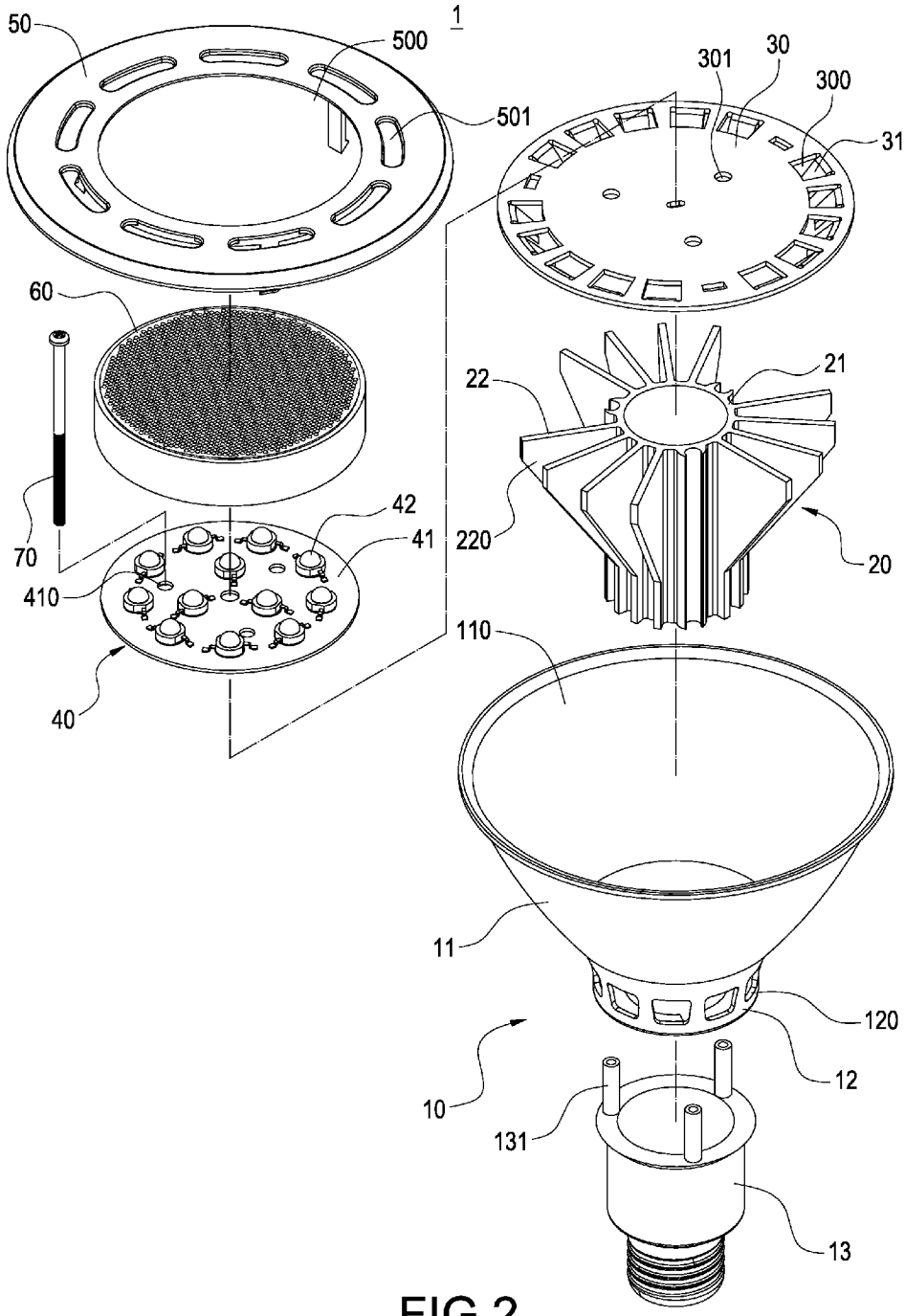
FIG. 2 is an exploded view of an LED lamp with a flow guide function in accordance with present invention.
Figure 3:
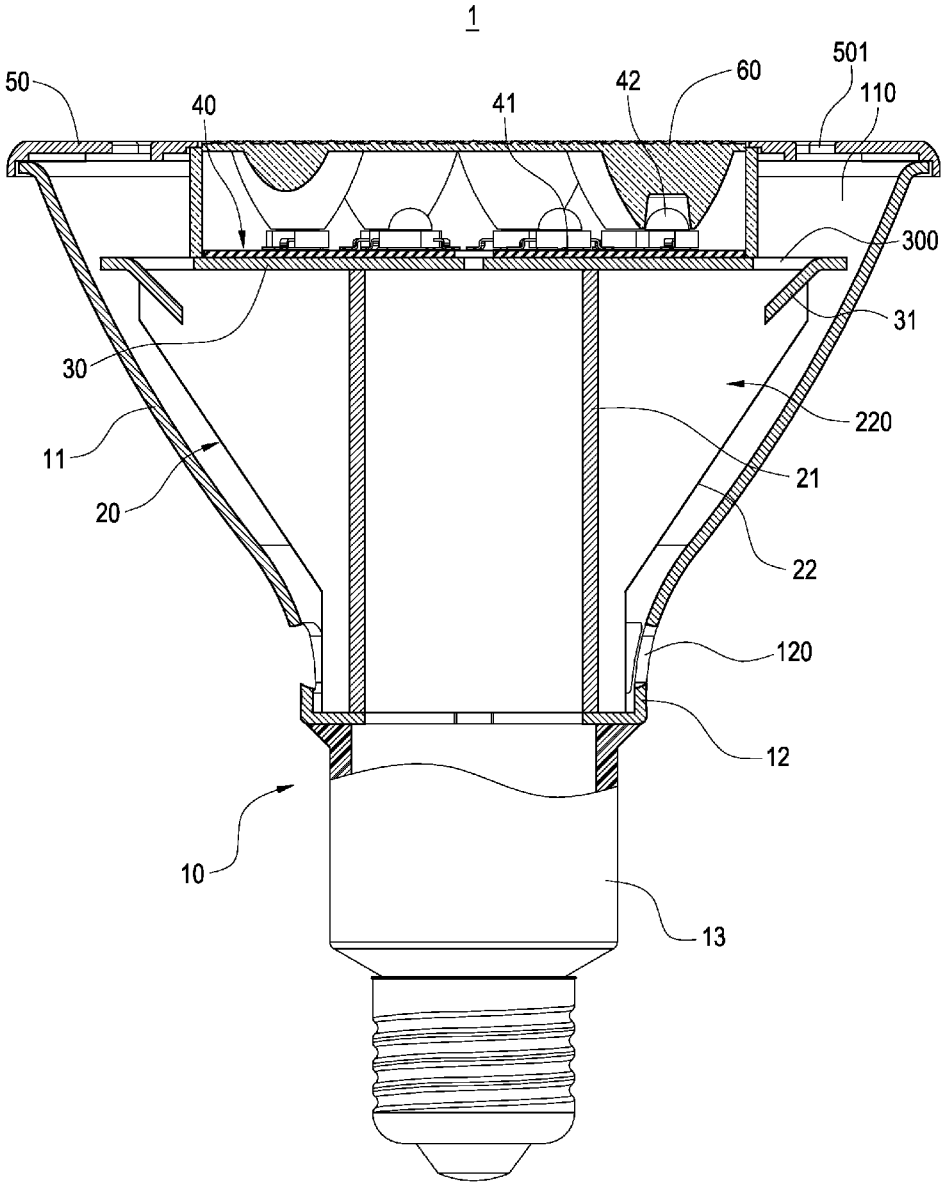
FIG. 3 is a cross-sectional view of an LED lamp with a flow guide function in accordance with present invention.

With reference to FIGS. 1 to 3 for a perspective view, an exploded view and a cross-sectional view of an LED lamp with a flow guide function in accordance with the present invention respectively, the LED lamp 1 comprises a lamp base 10, a heat dissipating body 20, a heat dissipating plate 30, an LED module 40, a cover 50 and a translucent lens 60.

The lamp base 10 includes a bowl-shaped lamp holder 11, a connecting section 12 extended from the bottom of the bowl-shaped lamp holder 11, and an electrically conductive connector 13. The bowl-shaped lamp holder 11 includes a containing space 110, a plurality of heat dissipating holes 120 formed on the connecting section 12, and the electrically conductive connector 13 is fixed to an external end of the connecting section 12 and includes a plurality of positioning pillars 131 formed on a distal surface of the electrically conductor connector 13.

The heat dissipating body 20 is installed in the containing space 110, and includes a hollow cylinder 21, a plurality of heat dissipating fins 22 formed with an interval apart from each other on an external surface of the hollow cylinder 21, and a heat dissipating passage 220 defined between any two fins 22 and the heat dissipating passages 220 installed corresponding to the heat dissipating holes 120 respectively.

The heat dissipating plate 30 is attached onto the heat dissipating body 20, and the heat dissipating plate 30 is a metal plate made of a good thermal conductivity, and substantially in a circular shape in this preferred embodiment. The heat dissipating plate 30 includes a plurality of openings 300 formed around the external periphery of the heat dissipating plate 30, a flow guide plate 31 formed at a lateral edge of each opening 300 and extended from the heat dissipating plate 30, and the flow guide plate 31 is obliquely coupled to a lateral edge of the opening 300. In addition, the heat dissipating plate 30 includes a plurality of combining holes 301 corresponding to the positioning pillars 131 of the electrically conductive connector 13 respectively.

The LED module 40 includes a printed circuit board 41 in a thermal contact with the heat dissipating plate 30 and a plurality of LEDs 42 electrically coupled to the printed circuit board 41, and the printed circuit board 41 also includes a plurality of penetrating holes 410 corresponding to the positioning pillars 131 of the electrically conductive connector 13 respectively.

The cover 50 is covered onto the bowl-shaped lamp holder 11 of the lamp base 10 to cover the LED module 40, and the cover 50 includes a containing hole 500 installed at a position corresponding to the LEDs 42, and the containing hole 500 includes a translucent lens 60, and a plurality of through holes 501 formed around an external side of the containing hole 500.

Firstly, the bowl-shaped lamp holder 11 is placed on the electrically conductive connector 13, and then the heat dissipating body 20, the heat dissipating plate 30 and the LED module 40 are sequentially contained in a containing space 110 of the bowl-shaped lamp holder 11, and then a plurality of locking elements 70 is passed through the combining holes 301 of the heat dissipating plate 30 and the penetrating holes 410 of the printed circuit board 41 and secured and fixed to the positioning pillars 131 of the electrically conductive connector 13 respectively, so as to fix the heat dissipating plate 30 and the LED module 40 onto the lamp base 10. Finally, the cover 50 combined with the translucent lens 60 is covered onto the bowl-shaped lamp holder 11 to complete assembling the LED lamp 1.

Figure 4:
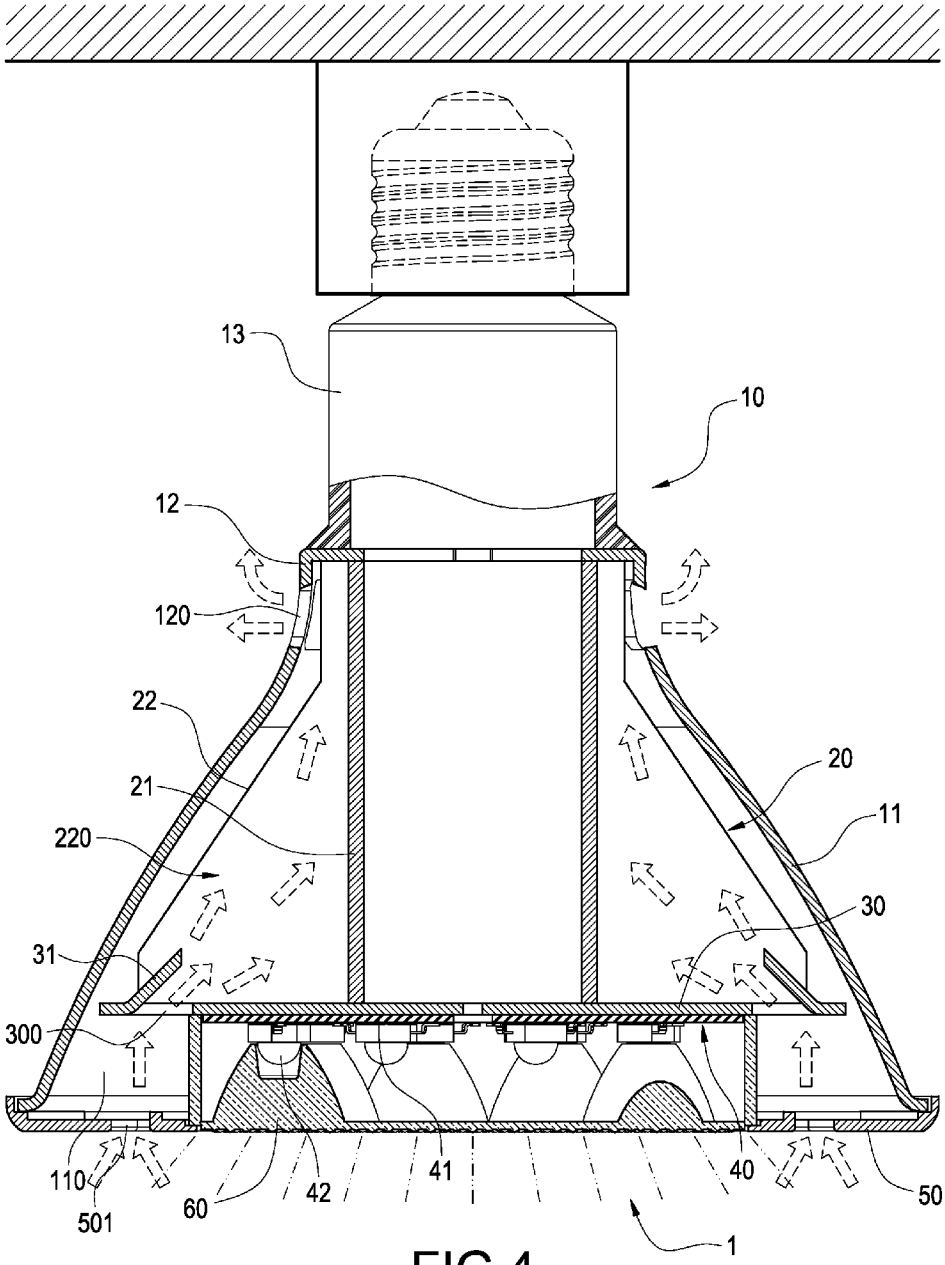
FIG. 4 is a schematic view of using an LED lamp with a flow guide function in accordance with present invention.

With reference to FIG. 4 for a schematic view of using an LED lamp with a flow guide function in accordance with present invention, when the LED lamp 1 is used, the light emitted by the LED 42 is refracted by the translucent lens 60, and the heat produced when the LED 42 emits light is conducted to the heat dissipating body 20 through the heat dissipating plate 30. On the other hand, after external air enters from the through hole 501 of the cover 50 and flows to the interior of the lamp base 10, cold air will enter into the opening 300 of the heat dissipating plate 30 and hot air will flow out from the opening 300 quickly. The hot air is guided by the flow guide plate 31 of the heat dissipating plate 30 and entered into the heat dissipating passages 220 of the heat dissipating fins 22, so that a large quantity of heat of the heat dissipating body 20 is carried away. When the air flows through the openings 300, the air is passed through the openings 300 with a smaller area, so that the airflow speed will be increased to expedite a natural convection, so as to achieve the effect of dissipating the heat of the heat dissipating body 20 quickly. Further, the density of the hot air will be changed and increased, and finally the heat is dispersed from the heat dissipating holes 120 of the lamp base 10 or from the surface of the bowl-shaped lamp holder 11, so as to lower the temperature of the LED lamp 1.

In summation of the description above, the present invention overcomes the shortcomings of the prior art, and complies with the patent application requirements, and thus is duly filed for patent application.

While the invention has been described by means of specific embodiments, numerous modifications and variations could be made thereto by those skilled in the art without departing from the scope and spirit of the invention set forth in the claims.

What is claimed is:

1. A light emitting diode (LED) lamp with a flow guide function, for guiding an external air to dissipate heat from the LED lamp, and the LED lamp comprising:

a lamp base, having a containing space, and a plurality of heat dissipating holes formed on the lamp base;

a heat dissipating body, installed in the containing space, and including a plurality of heat dissipating fins, a heat dissipating passage defined between any two fins, and the heat dissipating passages being installed corresponding to the heat dissipating holes respectively; a heat dissipating plate, attached and coupled onto the heat dissipating body, and including a plurality of openings formed around the heat dissipating plate, and a flow guide plate formed at a lateral edge of each opening and extended from the heat dissipating plate, and provided for guiding external air into the heat dissipating passage and out from the heat dissipating holes; and an LED module, including a printed circuit board in a thermal contact with the heat dissipating plate and a plurality of LEDs electrically coupled to the printed circuit board.

2. The LED lamp with a flow guide function as recited in claim 1, wherein the lamp base includes a bowl-shaped lamp holder having the containing space and a connecting section extended from the bottom of the bowl-shaped lamp holder.

3. The LED lamp with a flow guide function as recited in claim 2, wherein the heat dissipating holes are formed on the connecting section.

4. The LED lamp with a flow guide function as recited in claim 2, wherein the lamp base further comprises an electrically conductive connector fixed to an external end of connecting section.

5. The LED lamp with a flow guide function as recited in claim 4, further comprising a plurality of locking elements, and the electrically conductive connector including a plurality of positioning pillars formed thereon, and the heat dissipating plate corresponding to the positioning pillars and having a plurality of combining holes, and the printed circuit board corresponding to the positioning pillars and having a plurality of penetrating holes, and the locking elements being passed through the combining holes and the penetrating holes and locked onto the positioning pillars respectively.

6. The LED lamp with a flow guide function as recited in claim 1, wherein the heat dissipating body includes a hollow cylinder, and the heat dissipating fins are formed with an interval apart from each other on an external surface of the hollow cylinder.

7. The LED lamp with a flow guide function as recited in claim 1, wherein the flow guide plates are obliquely coupled to a lateral edge of the opening.

8. The LED lamp with a flow guide function as recited in claim 1, further comprising a cover covered onto the LED module, and the cover includes a plurality of through holes.

9. The LED lamp with a flow guide function as recited in claim 8, further comprising a translucent lens, and the cover includes a containing hole disposed at a position corresponding to the LEDs, and the translucent lens is combined into the containing hole.

10. The LED lamp with a flow guide function as recited in claim 9, wherein the through holes are disposed around an external side of the containing hole.

* * * * *